US006655111B2

(12) United States Patent
Ikemoto et al.

(10) Patent No.: US 6,655,111 B2
(45) Date of Patent: Dec. 2, 2003

(54) BAG MOUTH OPENING DEVICE FOR CONTINUOUSLY CONVEYED BAGS

(75) Inventors: Iwao Ikemoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/081,196

(22) Filed: Feb. 22, 2002

(65) Prior Publication Data

US 2002/0116898 A1 Aug. 29, 2002

(30) Foreign Application Priority Data

Feb. 23, 2001 (JP) ..... 2001-49446

(51) Int. Cl.[7] ..... B65B 43/30
(52) U.S. Cl. ..... 53/386.1; 53/470
(58) Field of Search ..... 53/385.1, 386.1, 53/562, 570

(56) References Cited

U.S. PATENT DOCUMENTS

| | | | | | |
|---|---|---|---|---|---|
| 3,821,873 | A | * | 7/1974 | Benner et al. | 53/437 |
| 4,035,988 | A | * | 7/1977 | Daniels | 53/562 |
| 4,481,064 | A | | 11/1984 | Westlund et al. | |
| 4,509,313 | A | * | 4/1985 | Koppe | 53/570 |
| 4,537,014 | A | * | 8/1985 | Emmerling et al. | 53/570 |
| 4,626,236 | A | * | 12/1986 | Maurer | 493/257 |
| 4,840,016 | A | * | 6/1989 | Muller, Jr. | 53/459 |
| 5,507,132 | A | * | 4/1996 | Gwiazdon et al. | 53/469 |
| 5,845,463 | A | * | 12/1998 | Henaux | 53/450 |
| 5,970,688 | A | * | 10/1999 | Nyiendo et al. | 53/573 |

FOREIGN PATENT DOCUMENTS

| | | |
|---|---|---|
| DE | 1050168 B | 2/1959 |
| GB | 1459508 A | 12/1976 |
| JP | S44-18473 | 8/1969 |
| JP | S59-221201 | 12/1984 |
| JP | S60-110624 | 6/1985 |
| JP | S61-49170 | 10/1986 |
| JP | H3-12645 | 3/1991 |
| JP | H6-80122 | 3/1994 |

* cited by examiner

*Primary Examiner*—Stephen F. Gerrity
*Assistant Examiner*—Paul Durand
(74) *Attorney, Agent, or Firm*—Koda & Androlia

(57) ABSTRACT

In a device that opens the mouth of each one of the bags that are suspended with the mouths facing upward and conveyed in a vertical state at a uniform speed and uniform spacing in a straight line, a pair of suction disks revolve continuously in mutually opposite directions on circular tracks on the horizontal plane so that the suction-chucking surfaces of the suction disks are always caused to face each other. The suction disks revolve at a constant speed while maintaining substantially symmetrical positions relative to each other and revolve at the same speed as the speed the bags are conveyed.

5 Claims, 6 Drawing Sheets

BAG MOUTH OPENING DEVICE FOR CONTINUOUSLY CONVEYED BAGS

BACKGROUND OF THE INVENTION

1. Field of the Invention

The present invention relates to a bag mouth opening device in which both side surfaces of the mouth of each one of continuously conveyed bags are suction-chucked by a pair of suction-chucking members disposed on both sides of the conveying path of the bags, and then the suction-chucking members are moved away from each other so as to open the mouth of the bag.

2. Prior Art

Follow-reciprocating type devices, rotating loop type devices, suction-chucking belt type devices, etc. have been known as conventional bag mouth opening devices used in continuous conveying type bag-filling packaging machines.

In the following-reciprocating type devices, suction-chucking members repeat a reciprocating movement that includes a following movement in the bag conveying direction stopping—return movement—stopping, and the mouth of a bang is opened during the following movement. Such a device is described in, for instance, Japanese Utility Model Application Publication (Kokoku) No. H3-12645.

However, the following-reciprocating type devices have drawbacks. First, a distance sufficient to accelerate the suction-chucking members from a stopped state to the conveying speed of the bags and a distance sufficient to decelerate and stop the suction-chucking members following the opening of the bag mouths are required. Thus, the distance for the reciprocating movement of the suction-chucking members tends to be long by a corresponding amount, resulting in an increase in the size of the packaging machine as whole, and a large installation space is also required. Second, time is required for acceleration and deceleration, thus hindering any increase in the operation speed of the packaging machine. Third, since a reciprocating movement is repeated, considerable vibration and noise are generated, causing deterioration in the quality of the work environment. This problem becomes conspicuous as the packaging machine is operated at higher speeds. Fourth, in cases where a plurality of sets of suction-chucking members are installed so that a plurality of bags are subjected to mouth opening at one time, the inertia increases, so that an even greater time and distance are required for acceleration and deceleration. As a result, the size of the apparatus tends to become larger, making it very difficult to increase the speed as desired.

In the rotating loop type devices, suction-chucking members are disposed at equal intervals on a chain mounted on a plurality of sprockets, and these suction-chucking members are caused to revolve at the same speed as the conveying speed of the bags. A part of the revolving path of the suction-chucking members is set so as to run along the conveying path of the bags, and the mouths of the bags are opened in this area. For example, such devices are described in Japanese Patent Application Laid-Open (Kokai) Nos. S59-221201 and S60-110624. A similar device is also described in Japanese Patent Application Publication (Kokoku) No. S44-18473.

The problems of these devices are that the structure is complex, and the maintenance and cleaning characteristics are poor. In addition, the cost of the device is high; and since the device is large in size, a large installation space is required for the packaging machine as a whole.

Furthermore, in the suction-chucking belt type devices, a pair of endless belts that have suction holes are caused to rotate at the same speed as the conveying speed of the bags. The belts are disposed so as to contact both surfaces of the bags symmetrically from either side of the bag conveying path and then separated from each other while moving. Such devices are described in, for instance, Japanese Patent Application Publication (Kokoku) No. S61-49170 and Japanese Patent Application Laid-Open (Kokai) No. H6-80122.

However, the suction-chucking belt type devices have problems in addition to those seen with the rotating loop type device. The suction-chucking belt type devices perform the mouth opening operation (suction and then separation) from one end of each bag. Accordingly, though this system is suitable for gazette bags (bags with both sides near the mouth folded into inside), mouth opening errors tend to occur in the case of ordinary flat bags or self-standing bags.

SUMMARY OF THE INVENTION

Accordingly, the present invention is to solve the problems encountered in such conventional bag mouth opening devices used in continuous conveying type bag-filling packaging machines.

Thus, it is an object of the present invention to provide a bag mouth opening device that is simple in structure and is more compact and that makes it possible to increase the operation speed of the device with little generation of vibration or noise.

The above object is accomplished by a unique structure for a bag mouth opening device for continuously conveyed bags in which both sides of a mouth of each one of the bags that are continuously conveyed at a uniform speed and equal intervals are suction-chucked by a pair of facing suction-chucking members, and then the suction-chucking members are moved away from each other so as to open the mouth of the bag; and in the present invention:

- the pair of suction-chucking members continuously revolve:
  - in mutually opposite directions on circular tracks on a plane that is substantially parallel to a conveying direction of the bags and substantially perpendicular to the surfaces of the bags, and
  - in a state in which suction-chucking surfaces of the suction-chucking members are kept facing each other; and
- time required for the respective suction-chucking members to complete one revolution is set to be at an integral multiple of time required for the each one of the bags to be conveyed over a distance between bags.

Preferably, the pair of suction-chucking members revolve at a constant speed while maintaining positions that are substantially symmetrical with respect to each other and also revolve at the same speed as the conveying speed of the bags.

The pair of suction-chucking members are provided so that each suction-chucking member of such pair is provided on each one of rotation transmitting members, and the suction-chucking member and the rotation transmitting member on which the suction-chucking member is provided perform a translational motion of the same radius of revolution and in the same direction of revolution as each other. The rotation transmitting members that perform the translational motion are always oriented to face in the same direction. Accordingly, the suction-chucking surfaces of the suction-chucking members likewise always face in the same direction (toward the front or face each other) when they are revolving. Of course, the revolution of the pair of suction-chucking members is thus also a translational motion. The mechanism that causes the rotation transmitting members to perform the translational motion comprises, for instance, two rotating shafts that rotate in synchronization in the same direction and respective supporting shafts that are provided in eccentric positions which are offset in the same direction and equal distances and revolve about the rotating shafts as the rotating shafts are rotated. The rotation transmitting members are provided on these supporting shafts and perform the translational motion.

A plurality of sets comprising pairs of suction-chucking members can be disposed along the conveying direction of the bags at intervals that are the same as the distance between bags (between the centers of bags next to each other in the conveying direction). In cases where only a single pair of suction-chucking members are disposed along the conveying path, the time required for the suction-chucking members to complete one revolution is set equal to the time required for each bag to be conveyed over the distance between bags. In cases, on the other hand, where a plurality of sets are disposed, the time required for the respective suction-chucking members to complete one revolution is set at the time obtained by multiplying the time required for each bag to be conveyed over the distance that corresponds to two bags next to each other by the number of sets of suction-chucking members. In this case, it is preferable to set the radius of revolution of the suction-chucking members to increase by the same factor.

The bag mouth opening device of the present invention is used mainly in a system in which bags are conveyed horizontally in the direction of width of the bags with the bags in a vertical attitude and with the bag mouths facing upward by way of suspending the bags with both edges thereof gripped by grippers or by way of holding the bags with retainers, etc. More specifically, the bag mouth opening device is applicable in general to systems in which bags are conveyed in their width direction or in their longitudinal direction with respect to the side surfaces of the bags. Thus, the bag mouth opening device of the present invention can be used in cases in which bags are conveyed in the longitudinal direction or cases in which bags are conveyed in the direction of width or longitudinal direction in a horizontal attitude.

Furthermore, the bag mouth opening device is used not only in cases where bags are conveyed along a straight line but also in cases where, for instance, bags are gripped by numerous grippers disposed around the circumference of a rotating table and are conveyed along a circular track that has a relatively large diameter. In such latter cases, the circular track of the suction-chucking members may be set by way of viewing the tangential direction of the conveying path at the point where the circular track reaches the conveying path (i.e., the suction-chucking point) as the conveying direction.

Furthermore, when bags are conveyed in the direction of bag width with the bags suspended in a vertical attitude, a bag bottom guide is provided in the vicinity of bottoms of the bags so that each one of the constituting elements of the bag bottom guide is disposed on either side of conveying path of the bags, so that the bag bottom guide comes into contact with curved surfaces of the bag and correct such curved surfaces

DETAILED DESCRIPTION OF THE INVENTION

The bag mouth opening device of the present invention will be described below with reference to FIGS. 1 through 6.

Figure 1:
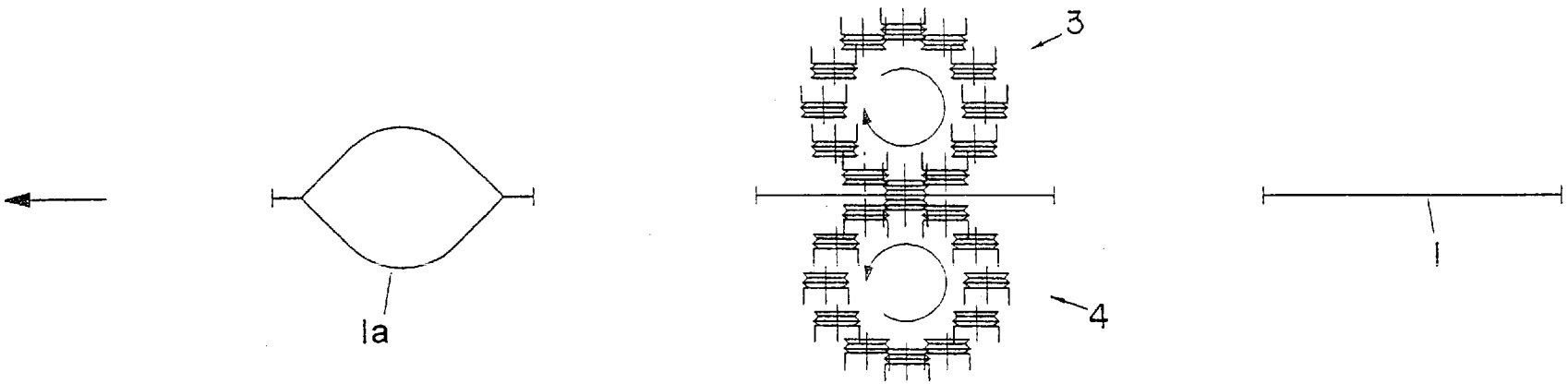
FIG. 1 is a schematic diagram that illustrates, when viewed from above, the operation of the suction-chucking members (suction disks) of the bag mouth opening device of the present invention.
Figure 2:
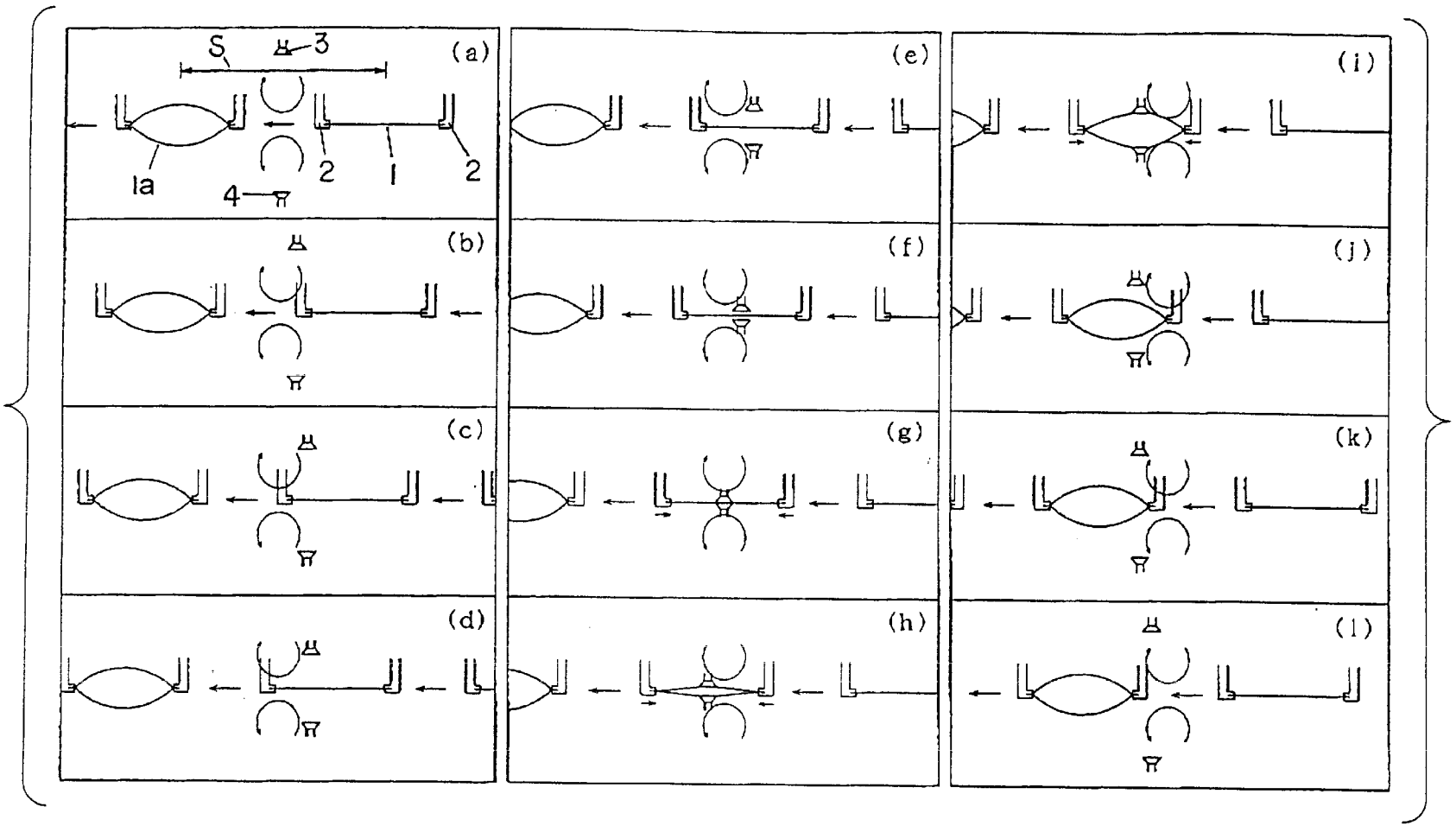
FIG. 2 is a schematic diagram, which illustrates the steps (a) through (l) taken in the bag mouth opening device.

In the continuous conveying type bag-filling packaging machine in which the bag mouth opening device is used, as shown in FIGS. 1 and 2, both (front and rear) edges of each one numerous bags 1 are gripped by grippers 2 so that the each bag 1 is suspended in a vertical attitude, and these bags are continuously conveyed along a conveying path (indicated by straight arrows) at a constant speed and uniform spacing.

The conveying path is set so as to be horizontal and rectilinear, at least in the area where a bag mouth opening is carried out (i.e., areas shown in FIGS. 1 and 2). A pair of suction-chucking members (suction disks 3 and 4) which form a part of the bag mouth opening device are disposed so that one suction-chucking member is on one side of the conveying path of the bags and the other is on another side.

The suction disks 3 and 4 revolve in mutually opposite directions on circular tracks on the horizontal plane as shown by substantially circular arrows. Thus, the suction-chucking surfaces of the suction disks 3 and 4 always face horizontally toward the front or constantly face each other, and the suction-chucking surfaces face the bag surfaces or face the side surfaces of the bags. This is the translational motion.

Each of the suction disks 3 and 4 revolves at a constant speed which is the same as the conveying speed of the bags. Also, the suction disks 3 and 4 revolve while maintaining mutually symmetrical positions as seen from the conveying path of the bags.

Moreover, the time the suction disks 3 and 4 complete one revolution is set so as to be equal to the time required for each bag 1 to be conveyed over the distance between bags (i.e., one pitch). Also, the circumferential length of the circular tracks on which the suction disks 3 and 4 revolve is set so as to be equal to the distance between bags (i.e. the distance that correspond to a distance between the centers of two bags next to each other).

Furthermore, the timing of the revolution of the suction disks 3 and 4 and the timing of the conveying of the bags are set so that when the suction disks 3 and 4 reach the conveying path of the bags (which is the point where the disks are brought closest to each other), the suction disks 3 and 4 come into contact the approximately center portion of the mouth of each bag 1 and suction-chuck the bag 1.

Steps (a) through (l) of FIG. 2 show the relationship between one cycle (one revolution) of the suction disks 3 and 4 and the movement of the bags. These steps will be described in a brief fashion as follows:

Steps (a) through (d):The suction disks 3 and 4 begin to approach each other while revolving toward the conveying path of the bags from positions that are furthest away from the conveying path, and an unopened bag 1 is approaching a specified suction-chucking position in a rectilinear movement. The reference numeral 1*a* is a bag that has been processed and its mouth is opened Steps (e) through (f): The suction disks 3 and 4 approach the mouth of the bag 1, and vacuum suction is initiated.

Step (g): The suction disks 3 and 4 reach the conveying path of the bags and elastically press the suction-chucking surfaces against the mouth of the corresponding bag 1 from both sides. As a result, the mouth of the bag is suction-chucked. At this time, the speed of the suction disks 3 and 4 in the conveying direction of the bags is equal to the conveying speed of the bags.

Steps (h) through (i): While suction-chucking the mouth of the bag, the suction disks 3 and 4 begin to separate from each other, and the mouth of the bag 1 is opened in Step (h). The speed of the suction disks 3 and 4 in the conveying direction of the bags gradually becomes lower as the suction disks 3 and 4 revolve; however, since flexibility of the bag 1 absorbs the speed difference with the bag 1, this presents no particular problems. In cases where a plurality of sets of these suction disks 3 and 4 are installed, the radius of revolution of the suction disks 3 and 4 is set at a larger value, so that the speed difference becomes smaller.

Step (j): The vacuum suction of the suction disks 3 and 4 stops, and the suction-chucking surfaces of the suction disks 3 and 4 are separated from the mouth of the bag 1.

Steps (k) and (l): The suction disks 3 and 4 are further separated or moved away from each other, and one cycle is completed.

In the above mouth opening steps, the suction disks 3 and 4 revolve continuously along their circular tracks. During this revolution, the suction-chucking surfaces are steadily maintained so as to face forward toward the bag side surfaces or toward each other (translational motion). Furthermore, the speed of the suction disks 3 and 4 in the conveying direction of the bags is the same or substantially the same as the conveying speed of the bags at the suction-chucking point and in the vicinity of the suction-chucking point. Accordingly, in relative terms, the mouth opening operation that is substantially the same as that of the conventional following-reciprocating type opening device (or opening operation) in which two suction disks are caused to advance and retract perpendicularly to and from the bag surfaces on both sides is realized. Thus, the mouth opening is performed assuredly; and since the mouth opening operation is performed in a continuous revolution movement of the suctions disks, it is possible to execute a high-speed operation.

The above-described bag mouth opening device will be described in concrete terms below with reference to FIGS. 3 through 6.

The suction disks 3 and 4 are fastened to the tip ends of opening arms 5 and 6, and the opening arms 5 and 6 are attached to plate-form rotation transmitting members 9 and 10 with attachment holders 7 and 8 in between. Each of the opening arms 5 and 6 is substantially a hollow pipe. The suction disks 3 and 4 are fastened to the tip ends of these opening arms 5 and 6, and pipe-form suction ports 11 are connected to points near the rear ends of the opening arms 5 and 6. These suction ports 11 cause the suction disks 3 and 4 to communicate with a vacuum source via filters, switching valves, etc. (not shown). The attachment holders 7 and 8 are fastened to the front ends of the rotation transmitting members 9 and 10, and the rear ends of the opening arms 5 and 6 are attached to these points.

Figure 4:
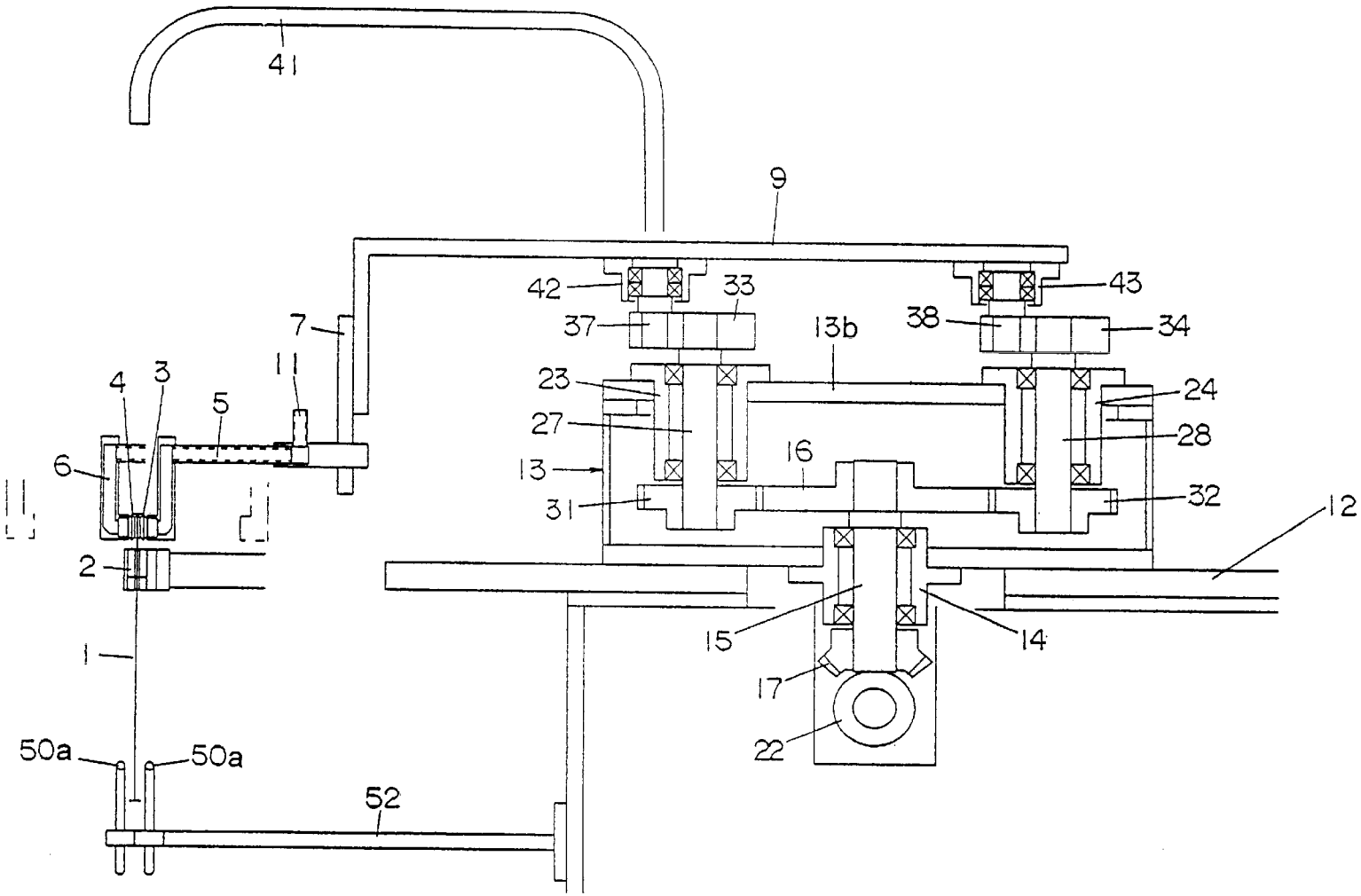
FIG. 4 is a partially sectional front view thereof.
Figure 5:
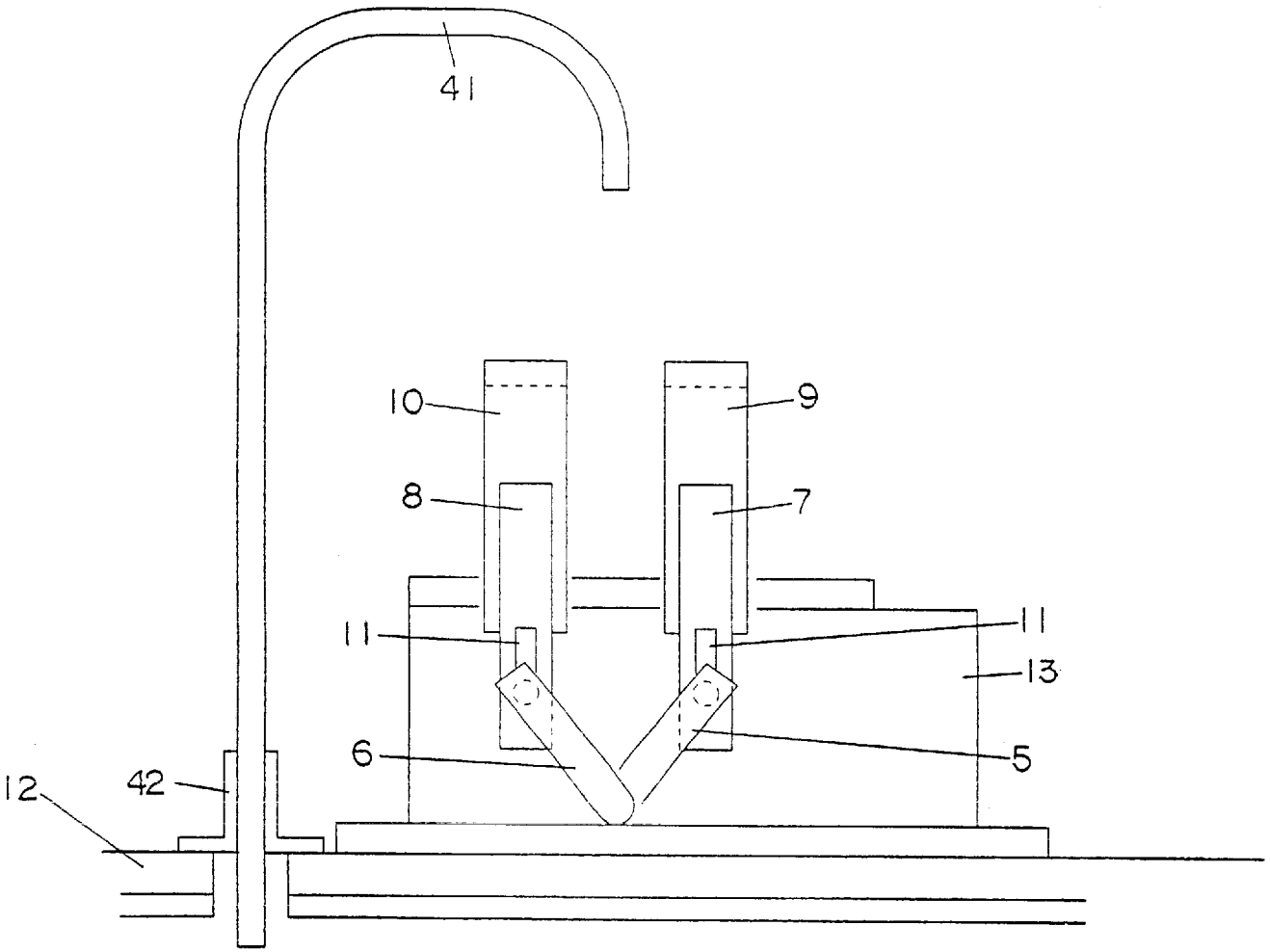
FIG. 5 is a left-side view thereof.

As seen from FIG. 4, a box-shape frame 13 is disposed on a base 12, and a bearing holder 14 is disposed on the bottom plate of this frame 13. A vertical shaft 15 is supported in this bearing holder 14 in a rotatable fashion. A spur gear 16 is fastened to the upper end of this shaft 15, and a bevel gear 17 is fastened to the lower end of the shaft 15.

Figure 6:
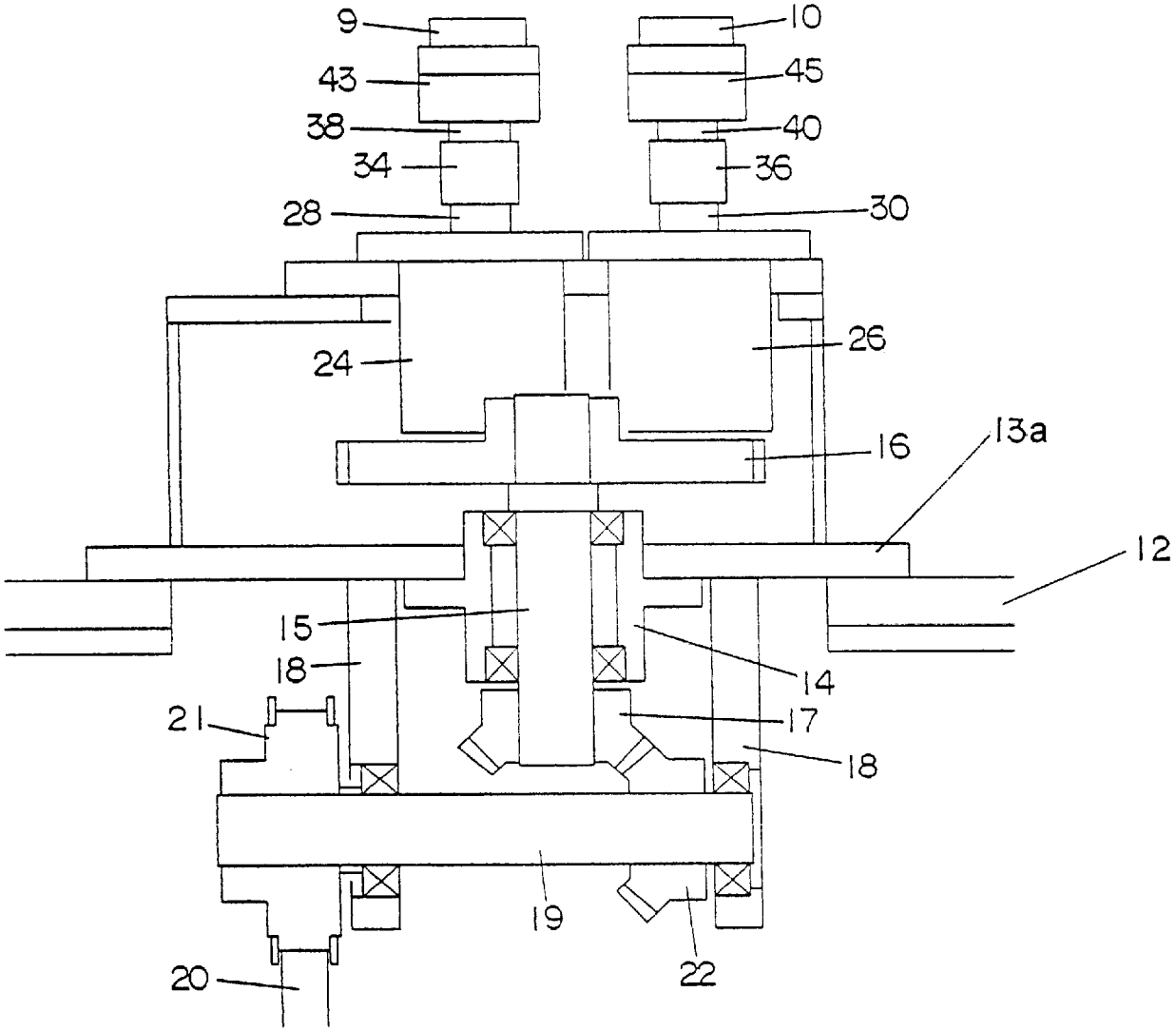
FIG. 6 is a partially sectional right-side view thereof.

A pair of bearing members 18 are, as shown in FIG. 6, suspended from the lower plate 13*a* of the frame 13, and a horizontal shaft 19 is rotatably supported by these bearing members 18. A toothed pulley 21 which is rotated by a timing belt 20 is fastened to one end of the horizontal shaft 19, and a bevel gear 22 which engages with the bevel gear 17 is fastened to a point near the other end of the horizontal shaft 19.

Figure 3:
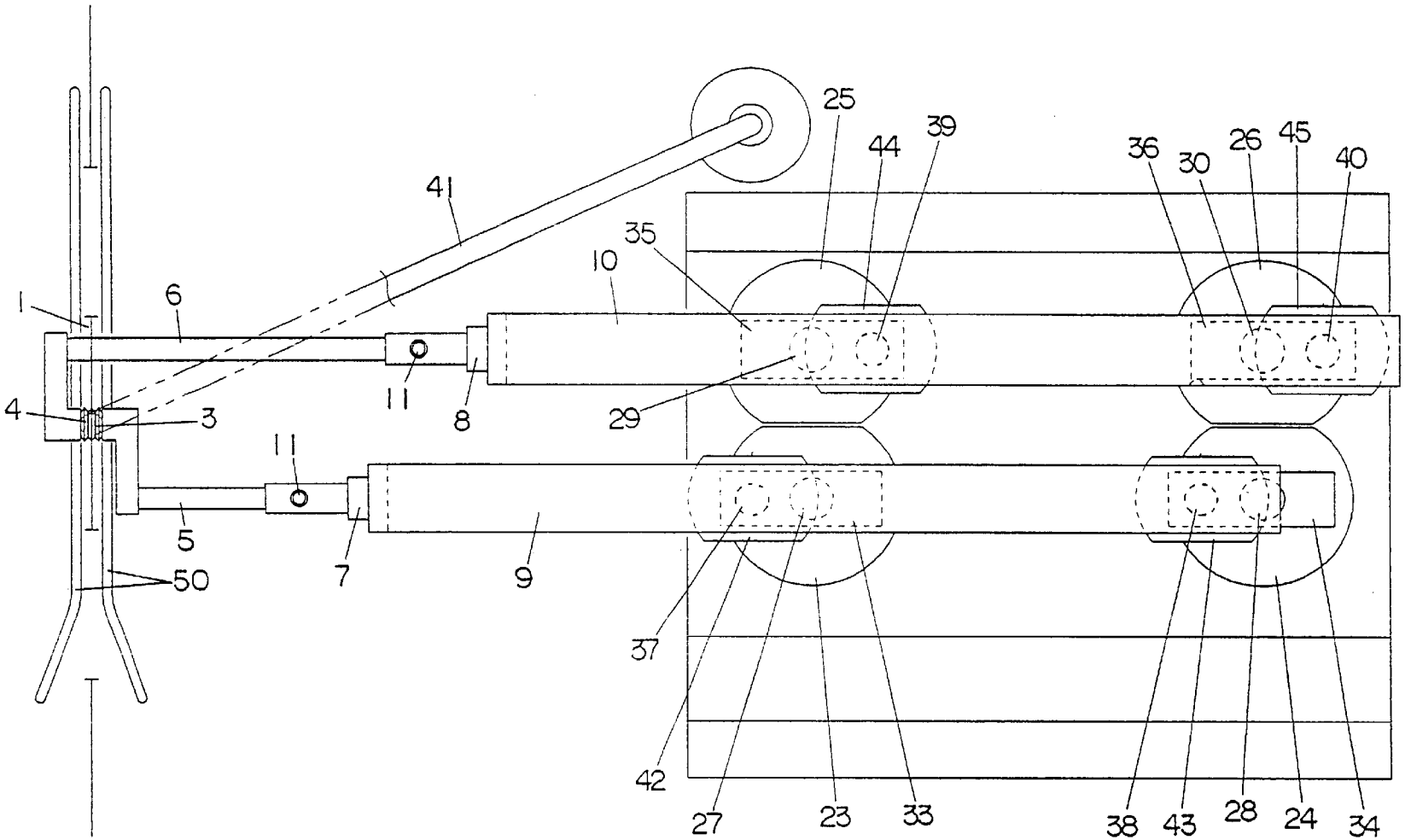
FIG. 3 is a top view of the bag mouth opening device of the present invention.

As seen from FIG. 3, a pair of bearing holders 23 and 24 which are lined up perpendicularly with respect to the conveying path of the bags 1 and a pair of bearing holders 25 and 26 which are likewise lined up near the bearing holders 23 and 24 are disposed on the upper plate 13*b* (seen FIG. 4) of the frame 13. Rotating shafts 27, 28, 29 and 30 are rotatably supported in the respective bearing holders 23, 24, 25 and 26. Respective spur gears are fastened to the lower ends of the shafts 27 through 30 (only the spur gears 31 and 32 fastened to the rotating shafts 27 and 28 are shown in FIG. 4), and rotating levers 33, 34, 35 and 36 are fastened to the upper ends of the shafts 27 through 30.

Furthermore, the lower ends of respective supporting shafts 37, 38, 39 and 40 are fastened to eccentric positions on the rotating levers 33, 34, 35 and 36, and the upper ends of these supporting shafts 37, 38, 39 and 40 are respectively supported in bearing holders 42, 43, 44 and 45 installed on the undersurfaces of the rotation transmitting members 9 and 10 in such a manner that the supporting shafts 37, 38, 39 and 40 are rotatable.

The supporting shafts 37 and 38 respectively correspond to the rotating shafts 27 and 28, and the supporting shafts 39 and 40 respectively correspond to the rotating shafts 29 and 30. The supporting shafts 37 and 38 are respectively provided in eccentric positions with respect to the rotating shafts 27 and 28 so that the supporting shafts 37 and 38 are offset in the same direction and equal distances. Likewise, the supporting shafts 39 and 40 are respectively provided in eccentric positions with respect to the rotating shafts 29 and 30 so that the supporting shafts 39 and 40 are offset in the same direction and equal distances.

However, the offset direction of the supporting shafts 37 and 38 with respect to the rotating shafts 27 and 28 and the offset direction of the supporting shafts 39 and 40 with respect to the rotating shafts 29 and 30 are set so that these directions differ by 180°.

In other words, when the supporting shafts 37 and 38 are at the closest positions to the conveying path, then the supporting shafts 39 and 40 are at the furthest position from the conveying path; and also, when the supporting shafts 37 and 38 are at the furthest positions from the conveying path, then the supporting shafts 39 and 40 are at the closest positions to the conveying path. FIG. 3 shows the timing in which the supporting shafts 37 and 38 are rotated about the rotating shafts 27 and 28 and brought to the closest positions to the conveying path of the bags 1, and the supporting shafts 37 and 38 are thus both on the left side of the rotating shafts 27 and 28; and at this point, the supporting shafts 39 and 40 are at the furthest positions from the conveying path, and the supporting shafts 39 and 40 are both on the right side of the rotating shafts 29 and 30; thus the supporting shafts 37 and 38 and the supporting shafts 39 and 40 are positioned in 180° opposite directions.

The spur gear 16 engages with the spur gears 31 and 32, the spur gear 31 engages with a spur gear (not shown) fastened to the lower end of the rotating shaft 29, and the spur gear 32 engages with a spur gear (not shown) attached to the lower end of the rotating shaft 30. Accordingly, when the timing belt 20 is rotated at a constant speed by a driving means (not shown), the rotating shafts 27 and 28 are caused to rotate in synchronization in the same direction via the toothed pulley 21, horizontal shaft 19, bevel gears 22 and 17, vertical shaft 15, spur gear 16 and spur gears 31 and 32; at the same time, the rotating shafts 29 and 30 are caused to rotate in synchronization in the opposite direction.

As a result, the eccentric supporting shafts 37 and 38 revolve in one direction about the rotating shafts 27 and 28, while the supporting shafts 39 and 40 revolve in another direction which is in the opposite direction from such one direction about the rotating shafts 29 and 30. As a result, based precisely on the principle of a parallel link mechanism, the respective rotation transmitting members 9 and 10 are caused to rotate in synchronization and at a constant speed in opposite directions on the horizontal plane in a state in which the rotation transmitting members 9 and 10 are always oriented perpendicular to the conveying direction of the bags 1. This rotation of the rotation transmitting members 9 and 10 is the translational motion. In accordance with this motion, the suction disks 3 and 4 attached via the attachment holders 7 and 8 and opening arms 5 and 6 revolve in mutually opposite directions as shown in FIGS. 1 and 2, with the same radius of revolution as the rotation transmitting members 9 and 10 and in a state in which the suction-chucking surfaces of the suction disks 3 and 4 are always oriented toward the front (or constantly oriented so as to face each other) and also are caused to face the bag surfaces (or the outer surfaces of the mouth of the bag).

A gas-blowing nozzle 41, which is connected to a compressed air source via filters, a switching valve, etc. (not shown), is installed in an upright position on the base 12 and is supported by a stand 42 (see FIG. 5). The gas-blowing nozzle 41 has a blowing opening, and this blowing opening of the nozzle 41 is set so as to face directly downward from a position directly above the conveying path where the suction disks 3 and 4 revolving along their respective circular tracks meet. The blowing opening of the nozzle 41 blows out, for example, air into the mouths of the bags 1 in synchronization with the vacuum suction of the suction disks 3 and 4, thus aiding in opening the mouth of the bags 1 by the suction disks 3 and 4.

As seen from FIGS. 3 and 4, a bag bottom guide 50 is provided by being supported on an attachment member 52 and disposed in a position beneath the base 12. The bag bottom guide 50 comprises a pair of rod-form members 50*a* installed parallel to each other, and such rod-form members 50*a* are formed so as to spread apart on the entry side with a specified straight gap in between for the remainder of the length of the rod-form members. The bag bottom guide 50 is disposed on the horizontal plane extending before and after the point where the circular tracks of the suction disks 3 and 4 meet. Thus, the bag bottom guide 50 comes into contact with the bags and corrects any warping of the bags 1 that are introduced to the point where the circular tracks of the suction disks 3 and 4 meet, thus aiding in smoothly opening the mouths of the bags. If the mouths of bags that are warped in excess of a certain degree of warping are opened "as is", the mouths may be warped and/or the warping of the bag may become even worse, making it difficult to correct such warping in subsequent processes.

In the bag mouth opening device described above, the suction disks 3 and 4 revolve at a constant speed on circular tracks. Accordingly, unlike the conventional devices, there is no need for the operating mechanism to accelerate the suction disks 3 and 4 from a stopped state or to decelerate the disks in order to stop the disks. Accordingly, a corresponding saving in terms of time and distance can be thus made, the packaging machine as a whole can be more compact, and only a small installation space is sufficient. Furthermore, the bag mouth opening device itself also generates little vibration or noise and can be operated at a high speed. In addition, since the structure is simple and compact, the maintenance characteristics and cleaning characteristics are improved. Moreover, since the suction disks 3 and 4 suction-chuck approximately the central portion of the mouth of each one of the bags and then open the mouth, an open state of the mouth is obtained in a secure and stable manner regardless of the bag configuration.

As seen from the above, according to the present invention, the structure of a bag mouth opening device in which the mouths of bags that are continuously conveyed are suction-chucked by a pair of suction-chucking members and opened can be simple, and it makes such a device more compact, reduces vibration and noise of the device and increases the speed of the bag mouth opening operation.

What is claimed is:

1. A bag mouth opening device for continuously conveyed bags in which both sides of a mouth of each one of bags that are continuously conveyed at a uniform speed and equal intervals are suction-chucked by a pair of facing suction-chucking members, and then said suction-chucking members are separated from each other so as to open said mouth of said each one of said bags, wherein:

said pair of suction-chucking members continuously revolve:

in mutually opposite directions on circular tracks on a plane that is substantially parallel to a conveying direction of said bags and substantially perpendicular to surfaces of said bags, and in a state in which suction-chucking surfaces of said suction-chucking members are kept facing each other;

time required for said respective suction-chucking members to complete one revolution is set to be at an integral multiple of time required for said each one of said bags to be conveyed over a distance between bags;

said pair of suction-chucking members revolve at a constant speed while maintaining substantially symmetrical positions with respect to each other and at a same speed as a conveying speed of said bags;

each suction-chucking member of said pair of suction-chucking members is provided on each one of rotation transmitting members;

said each suction-chucking member and said one of rotation transmitting members on which said each suction-chucking member is provided perform a translational motion of the same radius of revolution and in the same direction of revolution as each other; and a mechanism that causes said rotation transmitting members to perform said translational motion comprises:

two rotating shafts that rotate in synchronization in the same direction, and supporting shafts which are attached to said rotating shafts in eccentric positions that are offset by in the same direction and equal distances, said supporting shafts revolving about said rotating shafts as said rotating shafts rotate, wherein said rotation transmitting members perform said translational motion by way of being connected to said supporting shafts.

2. The bag mouth opening device according to claim 1, wherein:

a plurality of sets of said pairs of suction-chucking members are respectively lined up along said conveying direction of said bags at intervals that are equal to an intervals between said bags, and time required for each suction-chucking member to complete one revolution is set to be time that is obtained by multiplying time required for said each one of said bags to be conveyed over a distance between bags by number of said sets of said pairs of suction-chucking members.

3. The bag mouth opening device according to claim 2, wherein in a case where said bags are conveyed in a direction of widths of said bags in a vertically suspended state, a bag bottom guide is provided in the vicinity of bottoms of said bags so that each one of constituting elements thereof is disposed on either side of a conveying path of said bags, said bag bottom guide coming into contact with curved surfaces of said bag and correct said curved surfaces.

4. The bag mouth opening device according to claim 1, wherein in a case where said bags are conveyed in a direction of widths of said bags in a vertically suspended state, a bag bottom guide is provided in the vicinity of bottoms of said bags so that each one of constituting elements thereof is disposed on either side of a conveying path of said bags, said bag bottom guide coming into contact with curved surfaces of said bag and correct said curved surfaces.

5. A bag mouth opening device for continuously conveyed bags in which both sides of a mouth of each one of bags that are continuously conveyed at a uniform speed and equal intervals are suction-chucked by a pair of facing suction-chucking members, and then said suction-chucking members are separated from each other so as to open said mouth of said each one of said bags, wherein:

said pair of suction-chucking members continuously revolve:

in mutually opposite directions on circular tracks on a plane that is substantially parallel to a conveying direction of said bags and substantially perpendicular to surfaces of said bags, and in a state in which suction-chucking surfaces of said suction-chucking members are kept facing each other;

time required for said respective suction-chucking members to complete one revolution is set to be at an integral multiple of time required for said each one of said bags to be conveyed over a distance between bags;

said pair of suction-chucking members revolve at a constant speed while maintaining substantially symmetrical positions with respect to each other and at a same speed as a conveying speed of said bags;

each suction-chucking member of said pair of suction-chucking members is provided on each one of rotation transmitting members;

said each suction-chucking member and said one of rotation transmitting members on which said each suction-chucking member is provided perform a translational motion of the same radius of revolution and in the same direction of revolution as each other; and a mechanism that causes said rotation transmitting members to perform said translational motion comprises:

two rotating shafts that rotate in synchronization in the same direction, and supporting shafts which are attached to said rotating shafts in eccentric positions that are offset by in the same direction and equal distances, said supporting shafts revolving about said rotating shafts as said rotating shafts rotate, wherein said rotation transmitting members perform said translational motion by way of being connected to said supporting shafts; and each of said rotation transmitting members and said mechanism that causes said rotation transmitting member to perform said translational motion are both provide on one side of a conveying path of said bags.

* * * * *